US006907810B2

(12) United States Patent
Kim

(10) Patent No.: US 6,907,810 B2
(45) Date of Patent: Jun. 21, 2005

(54) PERFORATED BRAID WITH DUAL CORE YARNS AND BRAIDING APPARATUS

(76) Inventor: Im Sun Kim, 291 Deapyng-Ri, Chogae-Myun, Hapchun-Gun, Kyungsangnam-D0 (KR), 678-821

( * ) Notice: Subject to any disclaimer, the term of this patent is extended or adjusted under 35 U.S.C. 154(b) by 63 days.

(21) Appl. No.: 10/384,617

(22) Filed: Mar. 11, 2003

(65) Prior Publication Data

US 2004/0094024 A1 May 20, 2004

(30) Foreign Application Priority Data

Nov. 18, 2002 (KR) ..... 10-2002-0071523

(51) Int. Cl.[7] ..... D04C 3/24
(52) U.S. Cl. ..... 87/16; 87/28; 87/37; 87/41
(58) Field of Search ..... 87/5–9, 11, 13, 87/14, 16, 28–30, 33, 37, 38, 41, 62

(56) References Cited

U.S. PATENT DOCUMENTS 4,312,261 A * 1/1982 Florentine ..... 87/33
5,385,077 A * 1/1995 Akiyama et al. ..... 87/8
6,360,644 B1 * 3/2002 Bettger et al. ..... 87/33
6,453,789 B2 * 9/2002 Bettger ..... 87/33
2001/0025563 A1 * 10/2001 Bettger ..... 87/33

* cited by examiner

*Primary Examiner*—John Calvert
*Assistant Examiner*—Shaun R Hurley
(74) *Attorney, Agent, or Firm*—GWiPS

(57) ABSTRACT

A braiding apparatus for braiding the perforated braids with constant interval of perforations comprises a first braid section to braid one strand with a plurality of yarns, sequential braid section to braid with two strands and secondary sequential braid section to braid a final strand with the previous process of the strands. This braiding apparatus comprises a carrier guide plate (10) having a pair of core yarn holes (12), a plurality of coupling boles (13), two tracks of carrier contours (14), a base plate (40) having a plurality of carriers (20), feed gears (30), feed discs (31), feed gear shafts (32), actuators (42), carrier contour changers (50) including a main block (60), intermediate cross block (70) and inner split block (80) for performing repeated crossing and separating operations. So, the various braids with constant interval of perforations are possibly produced by differ the number of core yarns and carriers.

10 Claims, 12 Drawing Sheets

PERFORATED BRAID WITH DUAL CORE YARNS AND BRAIDING APPARATUS

BACKGROUND OF THE INVENTION

1. Field of the Invention

The present invention relates to a braiding apparatus and a perforated braid, which has dual cores. More particularly, a braiding apparatus for braiding the perforated braid with constant intervals of perforation forms a first braid section to braid one strand with a plurality of yarns, sequential braid section to braid a certain length of braid with two strands and another sequential braid section to braid final strand with the previous strands. The braiding apparatus equips a pair of carrier contour changers mounted underneath a carrier guide plate, which has a plurality of carriers, carrier contours and a pair of coupling holes to braid one or two strands of yarns by connecting or separating carrier contours.

2. Description of the Related Art

A braid is generally formed with a plurality of yarns that cross each other. The braid is used in various fields such as wire coatings, string hoses, binding twines and the like. The tubular braid is formed with a plurality of yarns braided around an outer circumferential surface of core yarns, wires or binding twine. This method allows the braided yarns to stretch or bend. Therefore, the flexible braided core yarns formed around the wire or twine provide protection for the inner substances from external impact or contamination. Currently, braids are widely used as binding twines for commodities such as shoes, apparels or the like as well as for specific uses.

A conventional braiding apparatus consists of a carrier guide plate provided with carrier contours along with a plurality of carriers, a plurality of feed goats for rotating a plurality of carriers along the carrier contours on the carrier guide plate, a drive gear for driving the plurality of feed gears and a plurality of rollers for winding the braided twine.

As shown in FIG. 1, a braiding apparatus for braiding a common tubular braid comprises two carriers crossed with each other and forming a slight in a zigzag pattern formed on a guide plate 100. A plurality of feed gears opposed to the crossing center of the carrier contours is disposed at a lower portion of the guide plate 100. Therefore, when the plurality of feed gears are driven altogether by the drive gears, a plurality of carriers 101, 101' installed on the carrier guide plate 100 are rotated and moved along the carrier contours on the guide plate 100.

The plurality of carriers 101, 101' rotates around the center of the guide plate 100 while traveling along the carrier contours. In this way, each of the carriers 101, 101' rotates and moves along the carrier contours of the guide plate 100 while crossing with each other. Thus, a plurality of yarns 102, 102' are braided to form a tubular braid 103 by the crossing and rotating of the carriers 101, 101', on the outer circumferential surfaces of core yarns.

However, the above-described tubular braid has a tubular common cross-section such as a shoe strap. The round braid is easily loosened due to loosing the friction force when the braid is moving very hard. For this reason, various kinds of binding means are introduced to solve the loosening problem.

To solve this problem, for example, a polygonal braid and its braiding apparatus are disclosed in Korean Patent No. 348360. The braiding apparatus for braiding a polygonal braid such as a rectangular braid as well as a triangular braid equips a carrier guide plate constructed such that a plurality of carrier contours are crossed with each other with an array of feed gears corresponding to the carrier contours.

Accordingly, the polygonal braids such as rectangular or triangular braids are used for binding twines of shoes or apparel. The polygonal braid has a larger sectional area than a tubular braid to increase the friction forces between the braids, which are leading to improve the binding force. The laces of shoes and apparels which are applied with the polygonal braids would not easily become loosened due to the increase in the binding force.

However, the above-described polygonal braid applied to the laces has disadvantages, particularly when knot is required to be frequently tied and untied. In this situation, the binding portion would have troubles or difficulties to untie easily.

When a knot is formed on a braid, the knot will exert unusual binding force on the braid depending on a person who makes knot. Thus, if the binding is made with strong force, it will be difficult to untie the knot. Contrary, if the binding is made with weak force, the knot will easily be loosened. Therefore, the binding means with proper binding force must be developed to solve such problems.

Relating to a fishing net or fishing line, there are used either tubular or polygonal braids to make continuous cross twines. The cross pattern is braided in such a manner that the branch lines are connected to the main lines with constant intervals. However, the cross patterns have a problem in that the binding portions of the branch line are easily slipped off thus displacing its original position and massing up the fishing net or fishing line after a certain time has elapsed. It would be burdensome and expensive to correct the displacement of the massed up binding portions in fishing net or fishing line.

Therefore, a new concept of braids with knot used for the various purposes is developed to prevent the displacement or loosening the binding portion.

SUMMARY OF THE INVENTION

An objective of the present invention is to provide a perforated braid with dual core yarns and a braiding apparatus which form a first braid section of a certain length to braid one strand with a plurality of yarns of carriers, sequential braid section of a certain length to braid with two strands of braid and another sequential braid section of a certain length to braid with previous strands to produce a perforated braid having continuous perforations with constant intervals. The braiding apparatus comprises a carrier contour changer mounted on a guide plate with a plurality of carriers to braid one strand and two strands of braid by connecting or separating carrier contours. Because the binding force is increased, the present braid is suitable applying to the binding twines as well as fishing nets or fishing lines that have binding portions between main lines and branch lines.

Another objective of the present invention is to provide a braiding apparatus which has a carrier guide plate formed with carrier contours, a base plate spaced underneath the guide plate at a certain interval, a plurality of carriers moving along the carrier contours formed on the carrier guide plate, a plurality of feed gears rotatably mounted on the base plate corresponding to feed discs fixed to the top of a feed gear shaft, the feed discs interposed to the carrier base disposed lower part of the carrier, wherein the carrier guide plate is provided with two core yarn holes, a plurality of coupling holes radially formed circumferential core yarn holes, two tracks of carrier contours formed in a zigzag pattern to a certain depth along the circumferential coupling holes and four square slots formed at crossing portions of the carrier contours in four directions from the center of the carrier guide plate, and each of the carrier contours are separately formed with inner and outer path around the coupling holes to cross the carrier contours repetitively; the feed discs mounted on top of the shafts interposed to the carrier base disposed at the lower part of the carrier; carrier contour changers mounted underneath the carrier guide plate. A pair of carrier contour changers mounted underneath the carrier guide plate and inserted into four square slots for operationally providing alternative tracks of said carrier contours to cross and separate the carriers at crossing portions of said carrier contours, and a pair of actuators mounted underneath said base plate connected to said carrier contour changers through operating rod, link and change rod, for repetitively crossing and separating operations. A pair of carrier contour changers mounted underneath the carrier guide plate further comprises a pair of change block assemblies and operating frames, the change block assemblies.

DETAILED DESCRIPTION OF THE PREFERRED EMBODIMENT

In order to achieve the above-mentioned objectives, the preferred embodiments of the present invention will now be described accompany with drawings.

A braid generally comprises multiple core yarns disposed at the center and a common coating braided with a plurality of yarns on the circumferential multiple interior core yarns.

Figure 11:
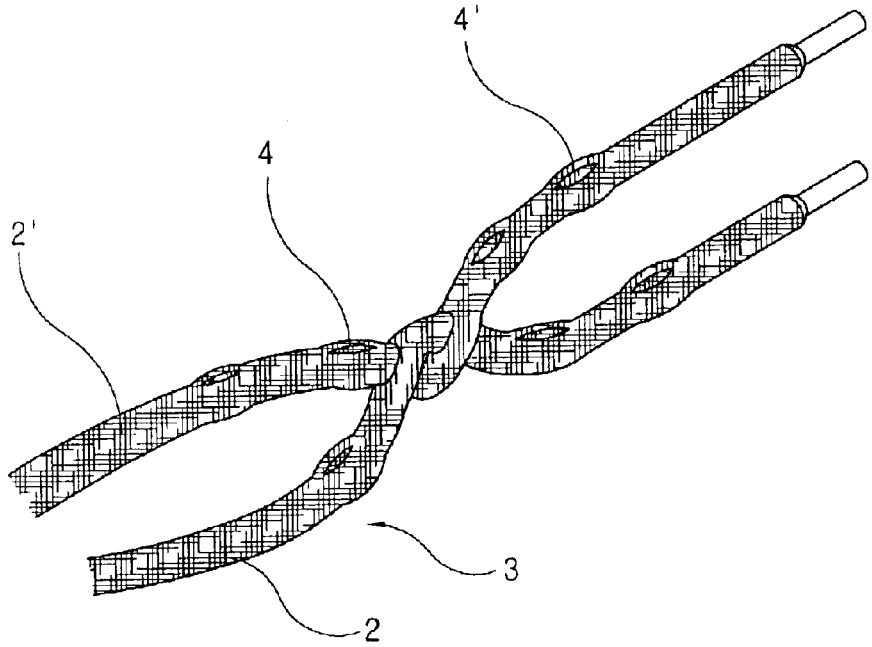
FIG. 11 is an expansive perspective view of a perforated braid formed by the braiding apparatus of the present invention.
Figure 12:
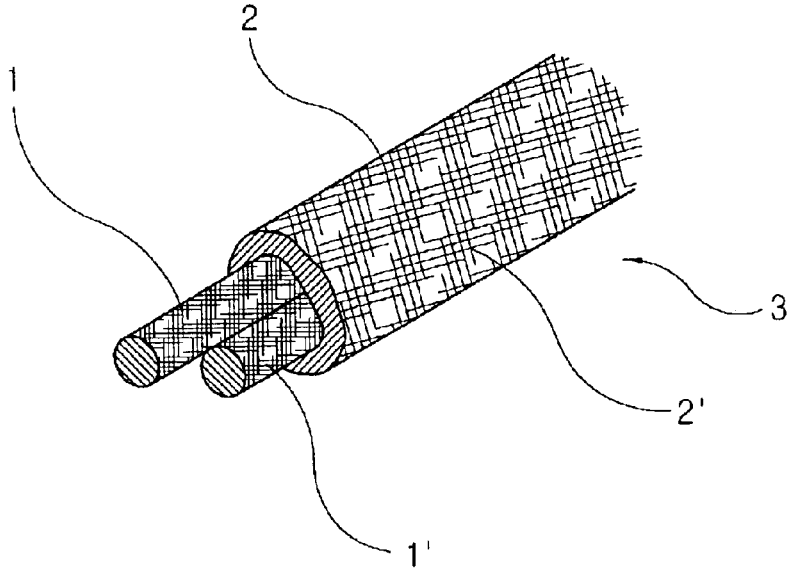
FIG. 12 is an expansive perspective view of a cross-section of the perforated braid produced by the braiding apparatus of the present invention.

Referring to FIGS. 11 and 12, the structure of perforated braid according to the present invention consists dual core yarns 1, 1' combined together with the common exterior braid 3. The common exterior braid 3 has a plurality of holes 4, 4' with constant intervals. A binding means or knot is provided, then a pair of braids is passed through the perforations.

Referring to FIGS. 2 to 5, a typical braiding apparatus includes a carrier guide plate 10 formed with carrier contours 14, 14', a base plate 40 located at a certain gap from a lower portion of guide plate 10, a plurality of carriers 20 moving along the carrier contours 14, 14' formed on the carrier guide plate 10, a plurality of feed gears 30 rotatably mounted on the base plate 40 corresponding to the carriers 20 and a feed disc 31 fixed to the upper end of the shaft 30*a* of the feed gear 30 and interposed at a carrier base 21 mounted to the lower end of the carrier 20. Herein, when the feed gear 30 is rotated, the feed disc 31 is repetitively inserted into and removed from the carrier base 21 of the carrier 20. Thus, the carrier 20 is repetitively rotated along the carrier contours 14, 14', thereby enabling the braiding of the braid 3.

To produce a perforated braid with dual core yarns, the braiding apparatus according to the preferred embodiment of the present invention is constructed as follows: The carrier guide plate 10 provides two separated core yarn holes 12, 12' located at the center of each half of the carrier guide plate 10, two sets of coupling holes 13, 13' arranged circumferentially around each core yarn hole 12, 12', two sets of carrier contours 14, 14' formed in zigzag patterns with a certain depth along the circumferential coupling holes 13, 13' and four slots 15, 15' diposed at the contacting portion of the carrier contours at a certain distance from the center of the carrier guide plate 10. Each carrier contour 14, 14' is separately formed inward and outward of the coupling holes 13, 13' to alternately cross each other.

Each feed gear 30 is mounted on the upper portion of the base plate 40 so that the circumferential feed disc 31 exposed above the coupling holes 13, 13' of the carrier guide plate 10 is interposed at the carrier base 21 located at the lower end of carrier 20.

Additionally, the carrier contour changers 50, 50' disposed under the carrier guide plate 10 are inserted through the slots 15, 15' of the carrier guide plate 10. A pair of change rods 51, 51' is inserted to these carrier contour changers 50, 50' so that the carrier contours 14, 14' can be crossed and separated repetitively at the crossing portion.

Moreover, a plurality of actuators 42, 42' having operating rods 41, 41' is mounted perpendicularly under the base plate 40. The actuators 42, 42' enable operation of the carrier contour changers 50, 50' via links 43, operating rods 41, 41' and change rods 51, 51' repetitively crossing and separating the carrier contours 14, 14'.

Figure 4:
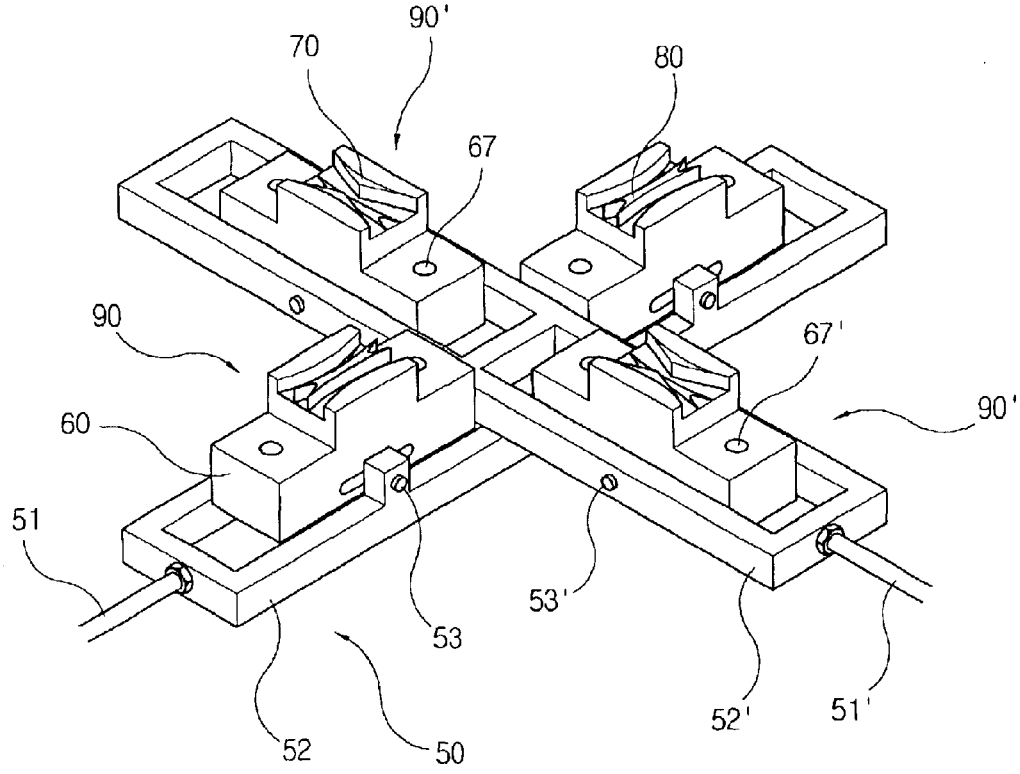
FIG. 4 is an overall perspective view of a carrier contour changer according to the present invention.
Figure 5:
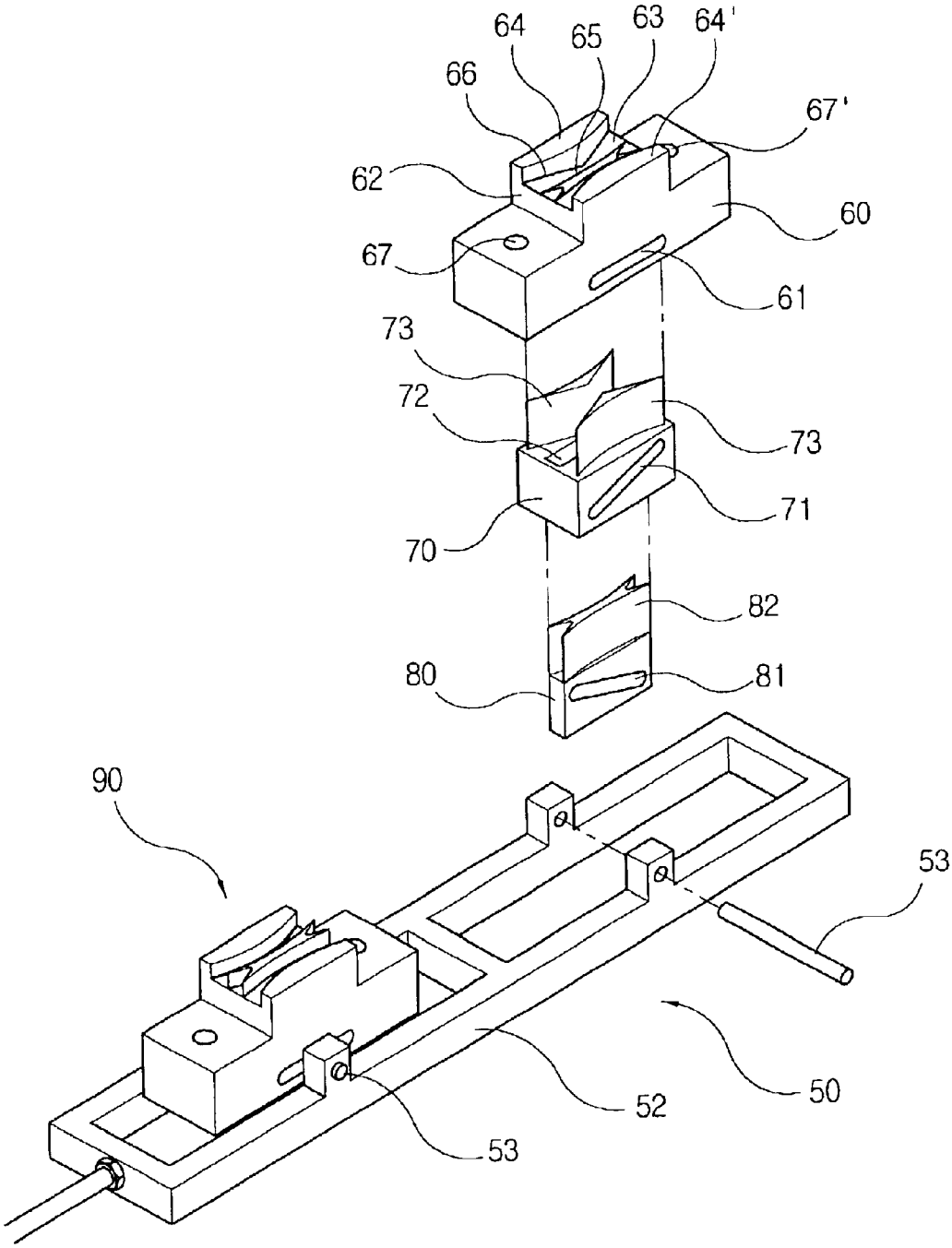
FIG. 5 is an exploded perspective view of principle parts of the carrier contour changer according to the present invention.

As shown in FIGS. 4 and 5, a pair of carrier contour changers 50, 50' connected to each end of change rods 51, 51' is constructed on each operating frame 52, 52'. The carrier contour changers 50, 50' are crossed and coupled to each other. A pair of change block assemblies 90, 90' are coupled on the operating frames 52, 52' by fixing pins 53.

As shown in FIG. 5, the change block assembly 90 includes a main block 60, an intermediate cross block 70 and an inner split block 80. The main block 60 comprises a longitudinal slot 61 formed at lower center of both lateral surfaces for transversely penetrating through the block, a pair of vertical coupling holes 67, 67' formed at opposite ends and perforated at a right angle, a protruded portion 62 formed at the center between both coupling holes 67, 67' and a concave recess 63, a vertical split rising opening 65 forming a rectangular shape at the center of the concave recess 63 and both side projections 64, 64' constituting the protruded portion 62 and cross rising openings 66 formed a triangular shape at opposite sides of the split rising openings 65. The intermediate cross block 70 comprises an inclined slot 71 penetrating through the block, a vertical inserting opening 72 formed at the center and a pair of cross guide flaps 73, 73' formed at opposite sides of the vertical insertion opening 72 for mating with the cross rising opening 66 of the main block 60. The inner split block 80 comprises a declined slot 81 formed at lateral surface in the opposite direction of the inclined slot 71 of the intermediate cross block 70 and a split guide flap 82 formed at the center of upper portion to mate with the split rising opening 65 of the main block.

Herein, a pair of fixing pins 53 inserted from one side of operating frame 52 is sequentially passed through the longitudinal slot 61 of the main block 60, the inclined slot 71 of intermediate cross block 70 and the declined slot 81 of the inner split block 80, thereby coupling the change block assembly 90 to the operating frame 52.

Additionally, an inner lateral surface of the concave recess 63 of the main block 60 has a convex shape protruded inwardly and an outer lateral surface of the cross guide flaps 73, 73' of the intermediate cross block 70 and both lateral faces of the split guide flaps 82 of the inner split block 80 has an inwardly recessed concave shape. In this manner, the carrier base 21 is able to move smoothly along the carrier contours 14, 14'.

In the thusly constructed braiding apparatus, a perforated braid with a different number of braided yarns 2, 2' and different shape can be produced depending on a number of the coupling holes 13, 13' formed on the carrier guide plate 10, shape of the carrier contours 14, 14' corresponding to the coupling holes 13, 13' and a number of the carriers 20 mounted on the feed disc 31.

For instance, the coupling holes 13, 13' radially formed circumferential each core yarn hole 12, 12' are able to be arranged in the manner that: for producing a perforated braid having sixteen strands of braided yarns 2, 2', total of eight coupling holes 13, 13' and corresponding carrier contours 14, 14' are radially formed circumferential each core yarn hole 12, 12'. Thus, eight feed discs 31 and sixteen carriers 20 are arranged at the coupling holes 13, 13' for circulating around the carrier contours 14, 14'.

For producing a perforated braid having twenty-four strands of braided yarns 2, 2', total of twelve coupling holes 13, 13' and corresponding carrier contours 14, 14' are radially formed circumferential each core yarn hole 12, 12'. The twelve feed discs 31 and twenty-four carriers 20 are arranged at the coupling holes 13, 13' for circulating around the carrier contours 14, 14'.

When a total of sixteen coupling holes 13, 13' and the corresponding carrier contours 14, 14' are radially formed circumferential each core yarn hole 12, 12' and sixteen feed discs 31 and thirty two carriers 20 are arranged at the coupling holes 13, 13' for circulating around the carrier contours 14, 14', a perforated braid having thirty-two strands of braided yarns 2, 2' could be produced.

Further, a total of twenty coupling holes 13, 13' and the corresponding carrier contours 14, 14' are formed radially circumferential each core yarn hole 12, 12' and twenty feed discs 31 and forty carriers 20 are arranged at the coupling holes 13, 13' for circulating around the carrier contours 14, 14', another perforated braid having forty strands of braided yarns 2, 2' is produced.

The perforated braid having multiple strands of braided yarns 2, 2' produced by the plurality of feed discs 31 and carriers 20 can be applied depending on the purpose or usage of perforated braids. For instance, forty eight or fifty six strands of perforated braids or the like can be produced as well as the above-described sixteen, twenty four, twenty six, thirty two or forty strands of perforated braids.

Hereinafter, a process for producing the perforated braid by using the braiding apparatus of the present invention will describe in detail with reference to the accompanying drawings.

First, according to the preferred embodiment of the present invention, a structure of braiding apparatus for producing a perforated braid comprised of twenty-four strands of braided yarns will be described with reference to the accompanying drawings.

Figure 1:
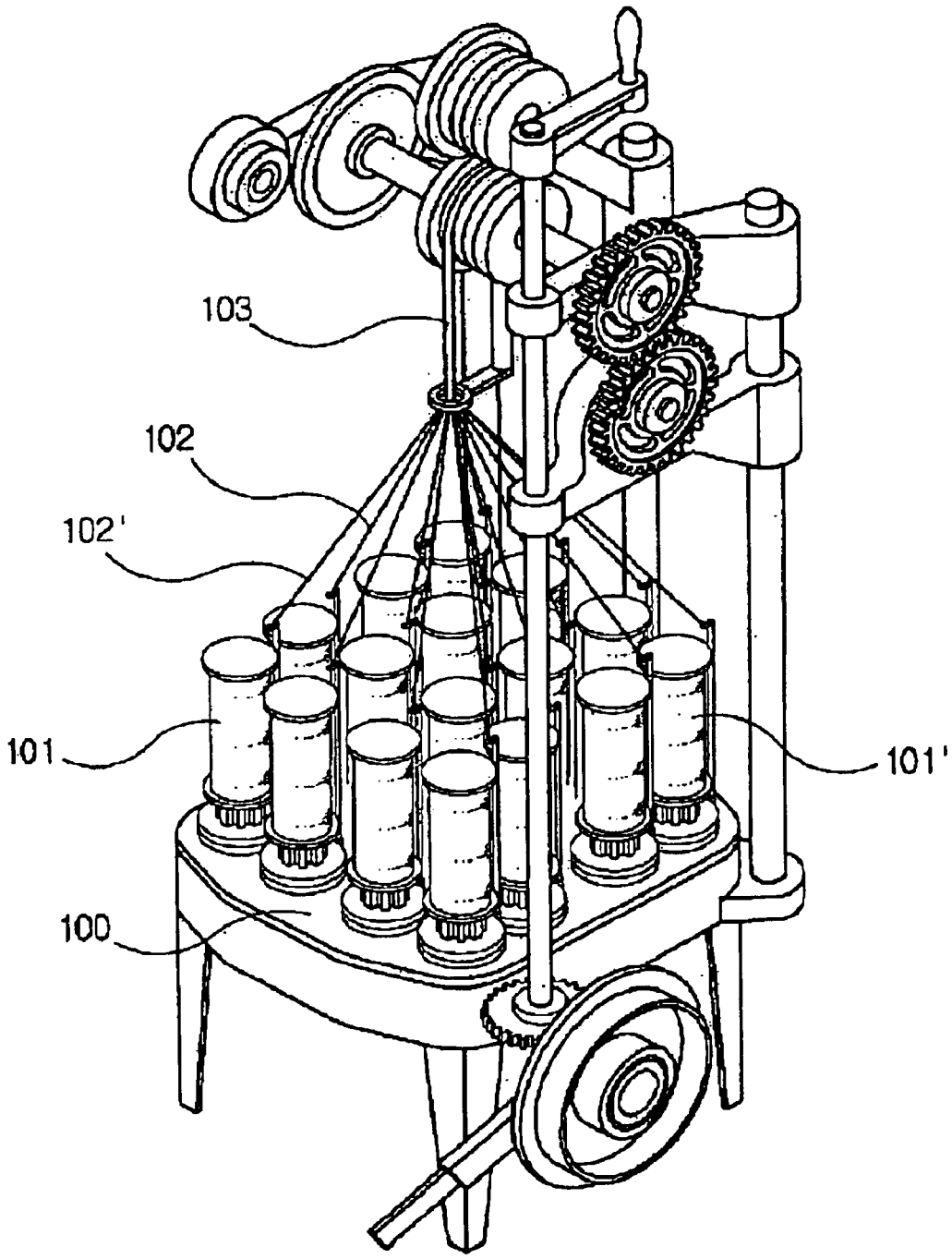
Fig. 1 (Prior Art)
FIG. 1 is a perspective view showing a braiding apparatus for producing a common tubular braid.
Figure 2:
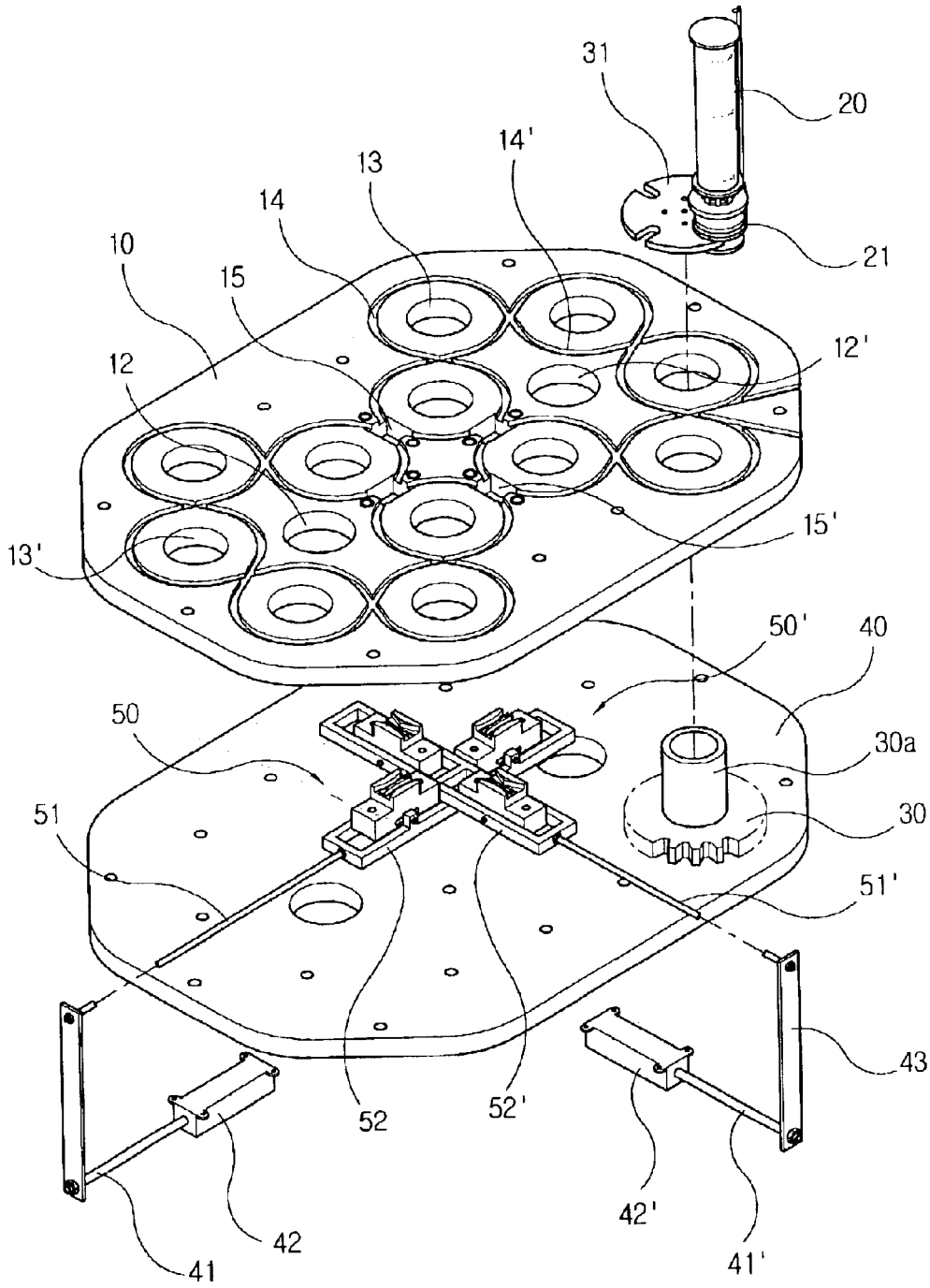
FIG. 2 is an exploded perspective view illustrating a substructure of braiding apparatus of the perforated braid according to the present invention.

As shown in FIG. 2, a pair of core yarn holes 12, 12' is formed at each center of half carrier guide plate 10. Each core yarn 1, 1' is supplied through each of the core yarn holes 12, 12' under the guide plate 10. A plurality of coupling holes 13, 13' is circumferentially formed around the core yarn holes 12, 12'.

The carrier contours 14, 14' having a certain depth on the circumferential coupling holes 13, 13' are paths for traveling the carrier base 21 which is disposed at lower part of the carrier 20. The carrier contours 14, 14' are continuously connected along the contour of the coupling holes 13, 13' in a zigzag pattern. The zigzag pattern of inner carrier contour 14' is formed in the opposite side of the outer carrier contour 14, whereby the two carrier contours 14, 14' are repetitively crossed with each other.

A feed disc 31 is located above the carrier guide plate 10 to interpose the carrier base 21. The feed disc 31 is coupled to the upper end of the shaft 30*a* of the feed gear 30 fitted to the coupling holes 13, 13' and rotated by rotation of feed gear 30. When the feed disc 31 is rotated by feed gear 30, the carrier base 21 and the carrier 20 travels along the carrier contours 14, 14'.

Herein, a base plate 40 is located at a certain interval under the carrier guide plate 10. The feed gear 30 is rotatably mounted on the base plate 40 to match with the coupling holes 13, 13' of the carrier guide plate 10. Additionally, two actuators 42, 42' are mounted under the base plate 40.

The actuators 42, 42' operate carrier contour changers 50, 50', which are attached under the carrier guide plate 10. When operating rods 41, 41' move forward or backward according to the actuators 42, 42', the movement of operating rods 41, 41' is transmitted to the change rods 51, 51' through links 43. Subsequently, the carrier contour changers 50, 50' connected to the change rods 51, 51' operates the change block assemblies 90, 90'. Hence, each carrier 20 is separately crossing with each other at a crossing point to switch the traveling path of the carrier contours 14, 14'. At this time, the carrier 20 rotates on the carrier guide plate 10 while traveling along the carrier contours 14, 14'.

Figure 3:
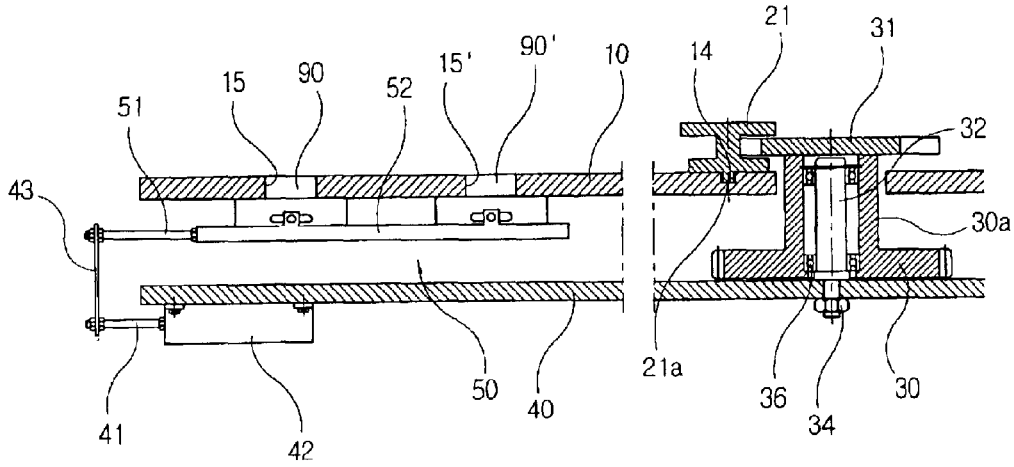
FIG. 3 is a cross-sectional view showing the semi-assembled substructure of the braiding apparatus of the perforated braid according to the present invention.

As shown in FIG. 3, the feed gear 30 integrally attached to a shaft 30*a* is mounted to the base plate 40 by a fixing axis 32 and nut 34. The feed gear 30 is rotatably mounted between the carrier guide plate 10 and the base plate 40 by the fixing axis 32 and a pair of bearings 36. When a power is transmitted through the shaft 30*a* by rotating of the feed gear 30, the carrier base 21 is rotated as the rotating of the feed disc 31 mounted on the upper end of the shaft 30*a*.

At the same time, when the actuators 42, 42' operate as described above, the operating force is transmitted to the carrier contour changers 50, 50' through the operating rods 41, 41', the links 43 and the change rods 51, 51'. Thus, two carrier contour changers 50, 50' operate the change block assemblies 90, 90' that are inserted into the square slots 15, 15'. At this time, a guide projection 21*a* disposed at the carrier base 21 is installed in the carrier contours 14, 14'. As the rotation of the feed gear 30, the feed disc 31 disposed above carrier guide plate 10 rotates the carriers 20 to travel along the carrier contours 14, 14' of the carrier guide plate 10.

In this manner, the plurality of yarns supplied through the core yarn holes 12, 12' are braided, while a plurality of carriers 20 is rotated and traveled along the carrier contours 14, 14'.

Herein, the actuators 42, 42' can be applied a cylindrical type as shown in the drawing or other operating means that can be performed a linear motion by electronic or mechanical means such as a solenoid or cam driving device.

As shown in FIG. 4, a pair of change block assemblies 90, 90' installed inside the operating frames 52, 52' is provided for crossing or separating operations of the plurality of carriers 20 along the carrier contours 14, 14'. The relative positions or tracks of the carrier contours 14, 14' varies depending on the location of the fixing pins 53, 53' mounted on the operating frames 52, 52'. The intermediate cross blocks 70 and inner split blocks 80 being disposed in the change block assemblies 90, 90' move upward or downward depending on the position of fixing pins 53', 53'.

Herein, a pair of operating frames 52, 52' is arranged to cross each other. At this point, each position of fixing pins 53, 53' mounted on the operating frames 52, 52' is arranged to locate the same distance below the carrier guide plate 10. Either one operating frame 52, which is positioned above, has a fixing pin 53 at the center of the thickness of the operating frame 52. Other operating frame 52', which is positioned below, has formed a raised position of fixing pin 53' to locate same position to the upper operating frame 52.

Therefore, the height of change block assemblies 90, 90' mounted inside the operating frames 52, 52' in the cross arrangement is same with each other. Thereby, the change block assemblies 90, 90' are inserted to the same level of the square slots 15, 15' formed on the carrier guide plate 10, and to match the same depth of the carrier contours 14, 14'.

As shown in FIG. 5, the change block assembly 90 disposed inside the operating frame 52 comprises a main block 60, an intermediate cross block 70 and an inner split block 80.

The main block 60 is constructed in such a manner that; a longitudinal slot 61 is formed for inserting the fixing pin 53 though the operating frame 52, a pair of fastener mounting holes 67, 67' are formed at opposite flat surfaces, and a protruded portion 62 is formed at the center of the block with a pair of arc-shaped projections 64, 64' at both end-sides. Additionally, a concave recess 63 is formed in the middle of the protruded portion 62 with vertical split opening 65 and a triangular shaped cross opening 66.

Next, the intermediate cross block 70 is constructed in such a manner that an inclined slot 71 is formed on a lateral surface and a vertical insertion opening 72 is formed at the center of the upper portion. Additionally, a pair of cross guide flaps 73, 73' is formed at both sides of the upper surface for inserting to the cross opening 66 of the main block 60.

The inner split block 80 is constructed in such a manner that: a declined slot 81 is formed at a lateral surface in the opposite direction of the inclined slot 71 of the cross block 70 and a split guide flap 82 for inserting to the split opening 65 of the main block 60 formed at the center of the upper portion. The split guide flap 82 is inserted to the insertion opening 72 of the intermediate cross block 70.

In the assembling process, the fixing pins 53 are inserted from the lateral side of the operating frames 52 sequentially passing through the longitudinal slot 61 of the main block 60, the inclined slot 71 of the intermediate cross block 70 and the declined slot 81 of the inner split block 80. The operating frame 52 moves forward or backward by the actuators 42 through the transmitting mechanism, the relative position of the inclined slot 71 and declined slot 81 to the fixing pin 53 is varied. Accordingly, the intermediate cross block 70 and the inner split block 80 operationally coupled to the fixing pin 53 through the inclined slot 71 and declined slot 81 to ascend or descend in directions from each other.

Figure 6A:
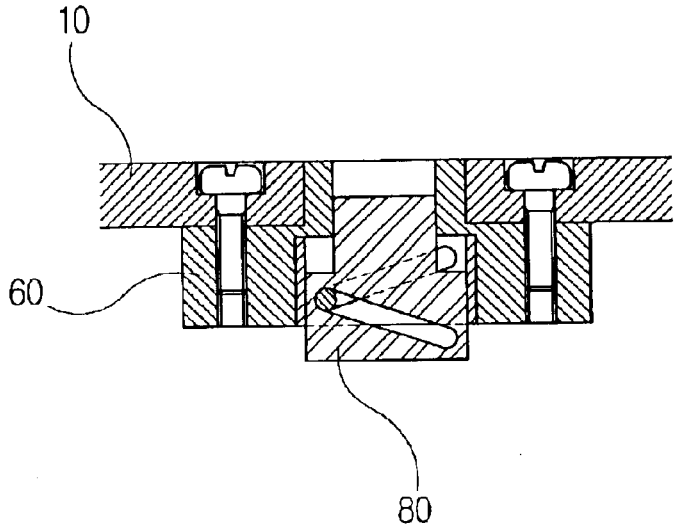
FIG. 6*a* is a side cross-sectional view showing the operating state of the carrier contour changer crossing the carrier contours.
Figure 6B:
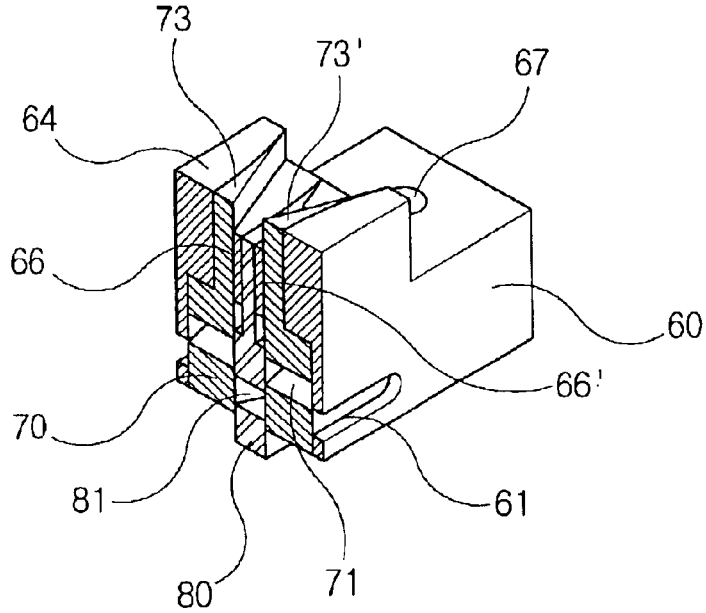
FIG. 6*b* is a cross-sectional perspective view showing the operating state of the carrier contour changer crossing the carrier contours.

As shown in FIGS. 6*a* and 6*b*, the upper end of the change block assembly 90 is mounted to the operating frame 52 by inserting from the underneath carrier guide plate 10 through the square opening 15. In this state, when the operating frame 52 moves forward unilaterally, the intermediate cross block 70 ascends and the inner split block 80 descends.

Since the carrier contours 14, 14' move to cross with each other, the carrier 20 is induced to move continuously without splitting the carrier contours 14, 14'. Hence, as described above, one strand of braid is produced by the carrier 20 traveling along the entire track of the carrier contours 14, 14'.

Figure 7A:
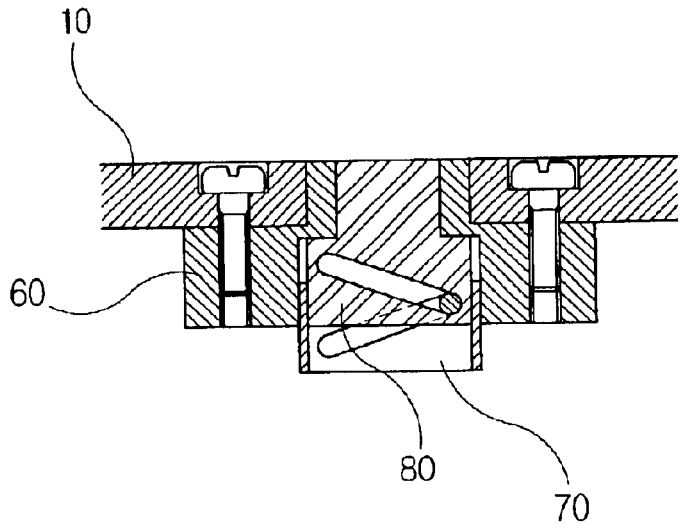
FIG. 7*a* is a side cross-sectional view showing the operating state of the carrier contour changer splitting the carrier contours.
Figure 7B:
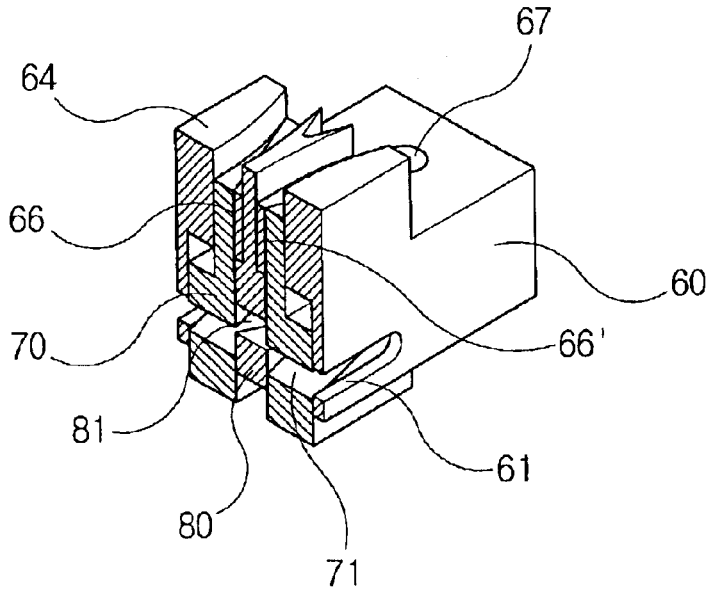
FIG. 7*b* is a cross-sectional perspective view showing the operating state of the carrier contour changer splitting the carrier contours.

As shown in FIGS. 7*a* and 7*b*, the upper end of change block assembly 90 is inserted from underneath carrier guide plate 10 through the square opening 15. When the operating frames 52 moves backward unilaterally, the intermediate cross block 70 descends and the inner split block 80 ascends.

In this case, since the carrier contours 14, 14' move to be separated from each other, this operation induces the carrier 20 partially moving without crossing the carrier contours 14, 14'. Hence, the carrier 20 traveling produces two strands of braid along the track of the carrier contours 14, 14'.

Figure 8:
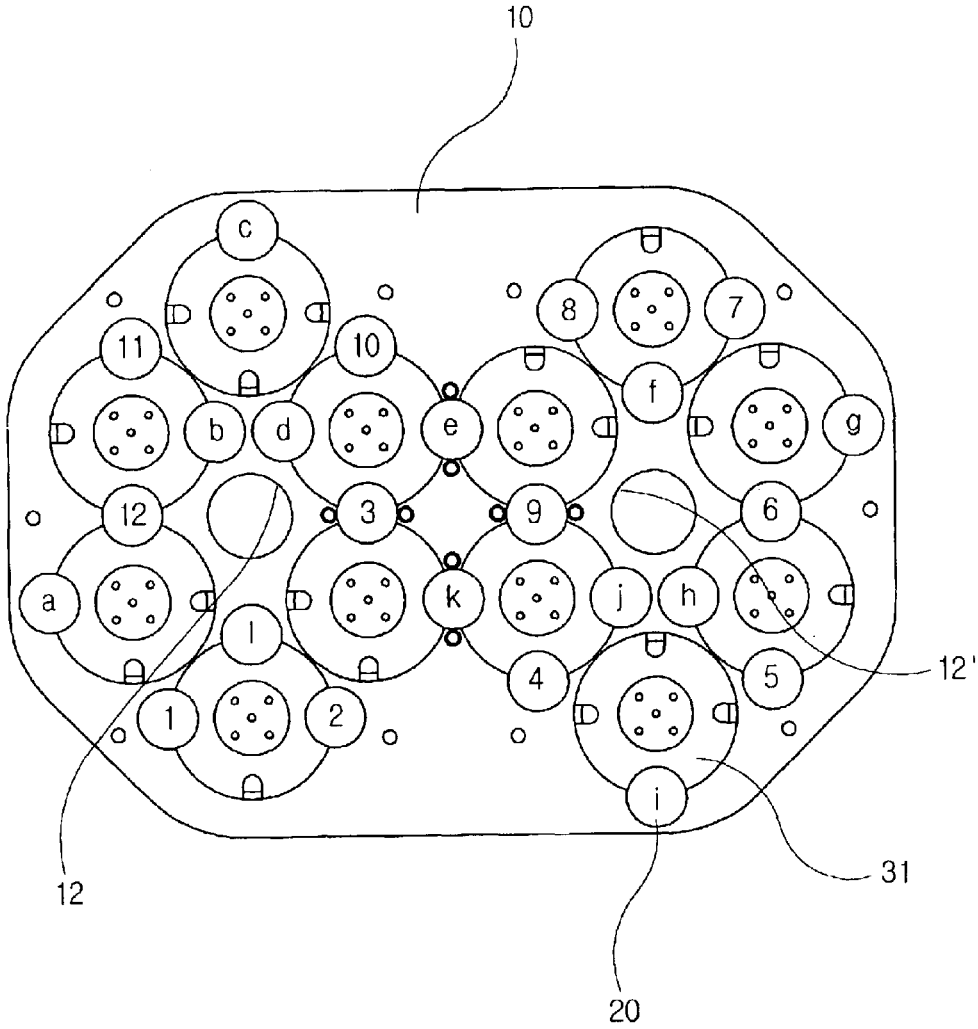
FIG. 8 is a plane view showing an arrangement of a plurality of carriers and feed discs on a carrier guide plate according to the present invention.

Referring to FIG. 8, the twelve feed discs 31 are located on the upper portion carrier guide plate 10 and twenty-four carriers 20 are mounted on the feed discs 31. At this point, since the feed gears 30 are engaged with each other, one feed disc 31 rotates while another adjacent feed gear 30 rotates reverse. As the result, one group of carriers proceeds in the forward direction by rotation of feed disc 31 and another group of carriers proceed in the reverse direction by reverse rotation of feed disc 31.

For example, when the carrier number one to carrier number twenty proceed clockwise, the carrier letter A to carriers number twenty L proceed counterclockwise.

According to the proceeding directions as described above, the braided yarns 2, 2' drawn from each carriers 20 are crossed each other at the crossing sections, a braid with circular section is braided.

Figure 9:
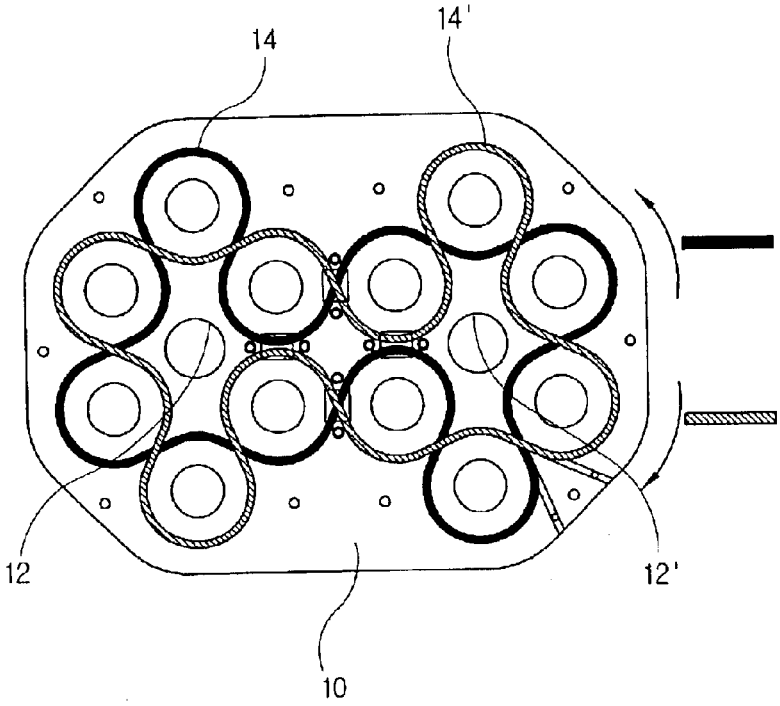
FIG. 9 is a diagram showing two tracks of the carriers on the carrier guide plate when one strand of carriers is braided by the braiding apparatus according to the present invention.

As sown in FIG. 9, the pair of carrier contour changers 50, 50' operates the change block assemblies 90, 90' in the upward and downward directions for crossing operation and in the left and right directions for splitting operation by providing two carrier contours 14, 14'. Thus, one strand of braid having dual core yarns is braided with the plurality of carriers 20 by proceeding in the forward or backward direction along the entire track of the carrier contours 14, 14'.

Figure 10:
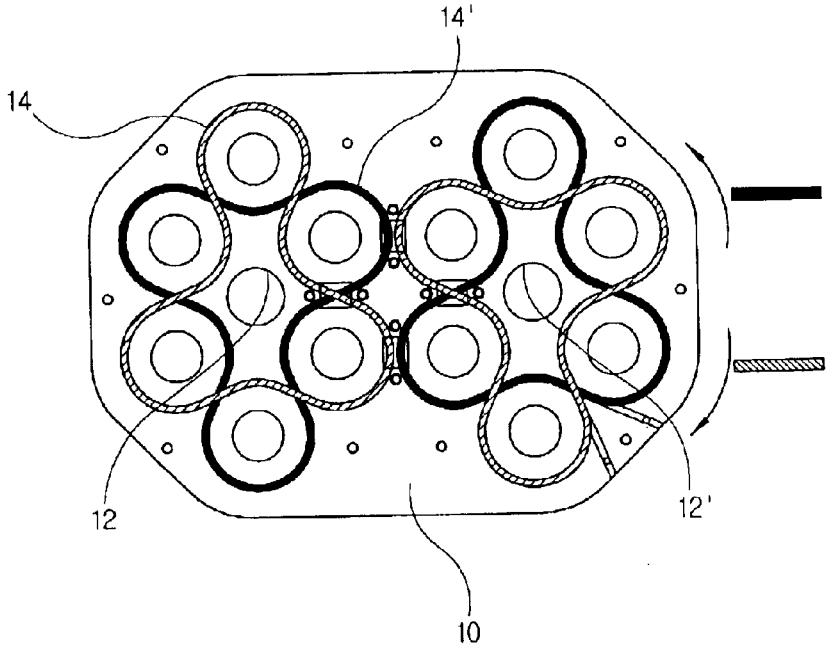
FIG. 10 is a diagram showing tracks of the carriers on the carrier guide plate when two strands of carriers are braided by the braiding apparatus according to the present invention.

As shown in FIG. 10, the traveling of the carriers is shown on the carrier guide plate when the two strands of carriers are braided.

The change block assemblies 90, 90' operate in upward and downward directions for splitting operation and in leftward and rightward directions for crossing operation by the carrier contour changers 50, 50'. Subsequently, four carrier contours 14, 14' are formed to produce two strands of braid having dual core yarns braided by the plurality of carriers 20 proceeding in forward or backward directions along the track of the carrier contours 14, 14'.

Thus, the perforated braid of the present invention is completed through the crossing and splitting operation by the carrier contour changers 50, 50'.

Herein, the size of perforation is controllable according to controlling the operating time of splitting and crossing of the carrier changers 50, 50'. If the operation of splitting time were prolonged, the size of perforation would be larger. Therefore, the size of perforation is proportional to the elapsed time of splitting operation.

Additionally, the interval of perforation is determined according to the cycle or alteration of the carrier contour changers 50, 50' for crossing and splitting operation. That is, it is determined how often the crossing and splitting operations are repeated. At this point, one strand of braid is formed by the crossing operation while two strands of braid are being alternatively formed by the splitting operation.

Typically, the carrier contour changers 50, 50' are operated by a general delay circuit or control circuit, so a detailed description thereof will be omitted.

As shown in FIG. 11, an end portion of perforated braid is produced by repeating the braiding with one strand and two strands of braid. The perforated braid 3 comprises dual interior core yarns 1, 1' combined in parallel, a common exterior braid 3 with a plurality of perforations 4, 4'. The perforations 4, 4' on the common exterior braid 3 are arranged with constant intervals. A binding means or knot is provided for combining a pair of braids by passing through the perforations each other.

As shown in FIG. 12, one strand of braid 3 comprises dual interior core yarns 1 and 1', which are combined in parallel and a common exterior braid 2. In case of braiding two strands of braids, dual interior core yarns 1 and 1' may be separated to locate each strand, respectively.

Figure 13:
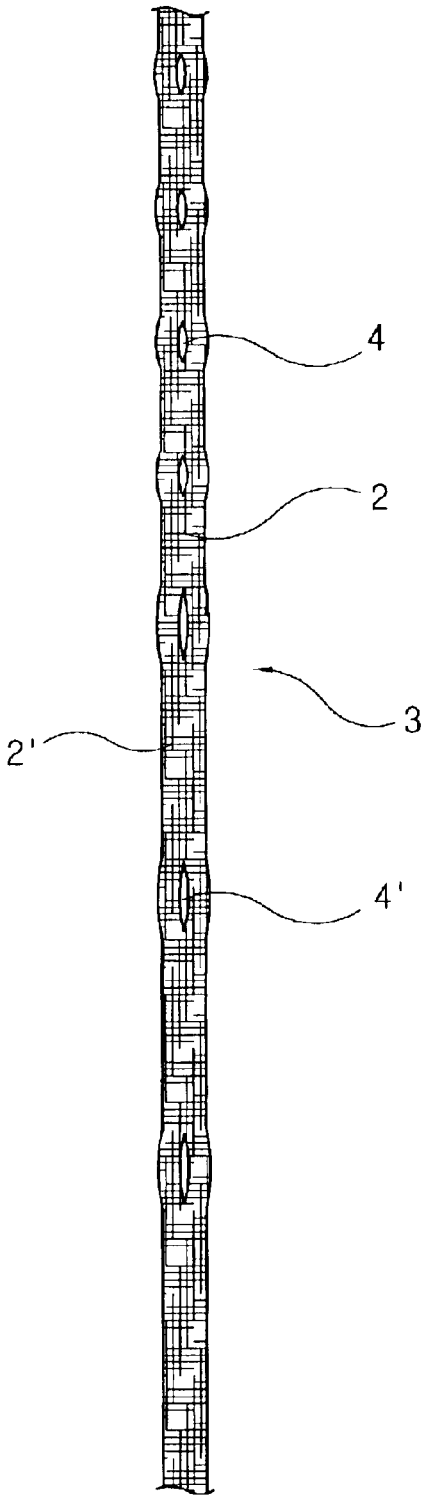
FIG. 13 is a plane view showing the perforated braid produced by the braiding apparatus according to the present invention.

As shown in FIG. 13, the size and interval of perforations 4, 4' of the perforated braid 3 can be varied depending on the purpose of usages.

Figure 14:
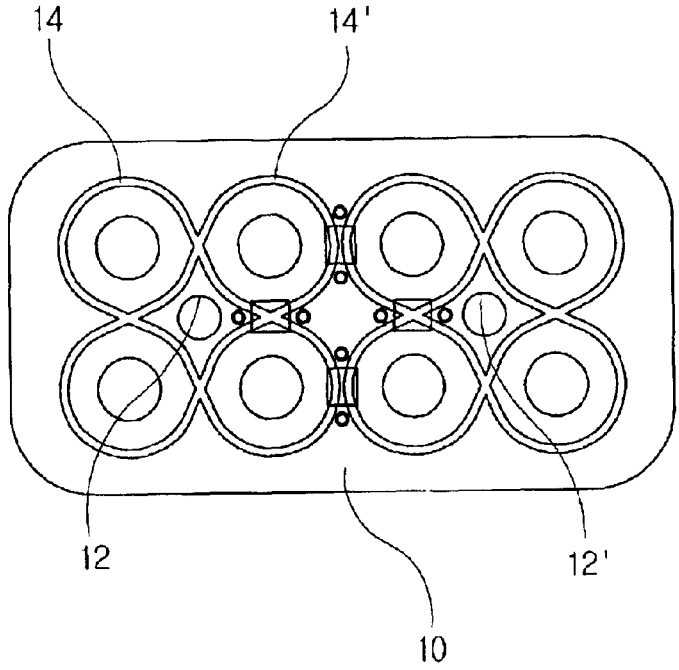
FIG. 14 is a plane view showing an arrangement of eight coupling holes on the carrier guide plate for the braiding apparatus according to another embodiment of the present invention.

Referring to FIG. 14, a carrier guide plate applied to sixteen carriers has the coupling holes 13, 13' radially formed circumferential each core yarn 12, 12'. In this case a total of eight coupling holes 13, 13' and corresponding carrier contours 14, 14' are formed on the carrier guide plate 10. It also provides eight feed-discs 31 and sixteen carriers 20 located at the coupling holes 13, 13'. Therefore, a perforated braid with sixteen strands of braided yarns 2, 2' is produced by circulating around the carrier contours 14, 14'. It is appreciated that the perforated braid produced by the sixteen strands of braided yarns has the same shape as the perforated braid produced by twenty-four strands of braided yarns 2, 2'. But, it has relatively smaller number of strands of braided yarns 2, 2'.

Figure 15:
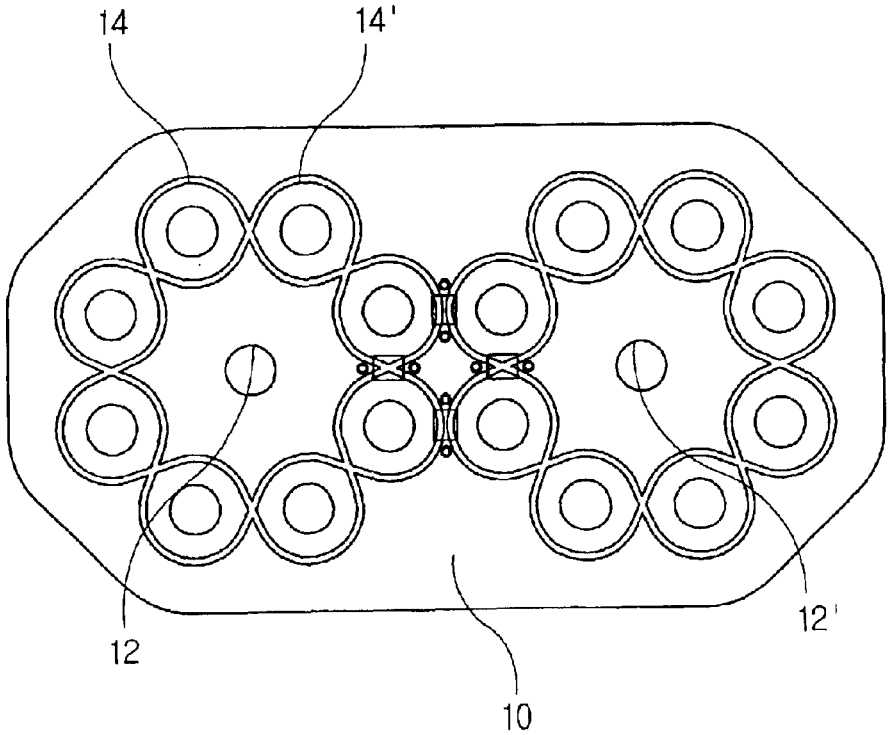
FIG. 15 is a plane view showing an arrangement of sixteen coupling holes on the carrier guide plate for the braiding apparatus according to another embodiment of the present invention.

Referring to FIG. 15, a carrier guide plate applied to thirty-two carriers comprises the coupling holes 13, 13' radially formed circumferential each core yarns 12, 12' on the carrier guide plate 10. In this case, a total of sixteen coupling holes 13, 13' and corresponding carrier contours 14, 14' are formed on the carrier guide plate 10. It also provides sixteen feed-discs 31 and thirty-two carriers 20 located at the coupling holes 13 and 13'. Therefore, a perforated braid with thirty-two strands of braided yarns 2, 2' is produced by circulating around the carrier contours 14, 14'.

Figure 16:
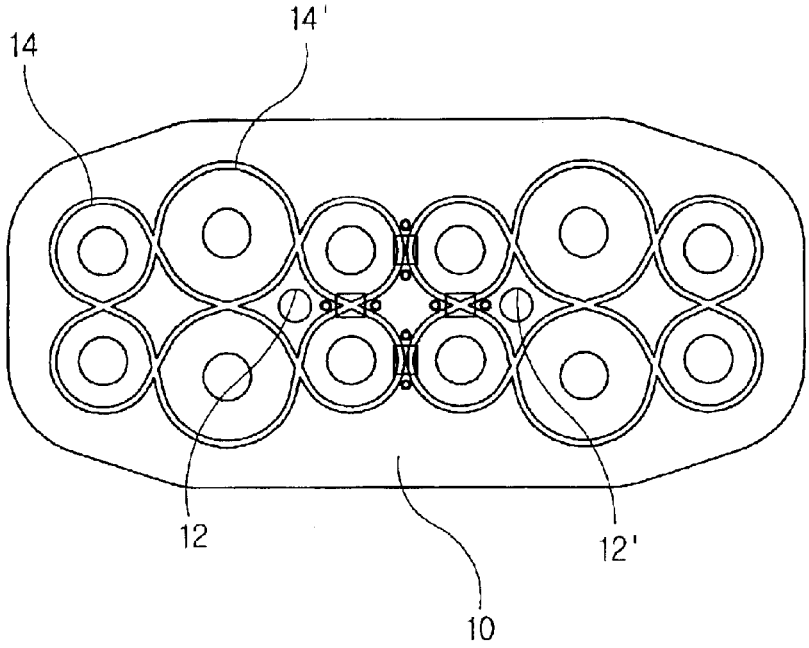
FIG. 16 is a plane view showing an arrangement of sixteen coupling holes on the carrier guide plate for the braiding apparatus according to another embodiment of the present invention for producing a perforate braid with a rectangular cross-section.

As shown in FIG. 16, a carrier guide plate 10 for producing a perforated braid with a rectangular cross-section comprises four coupling holes 13, 13' circumferentially formed around each core yarn holes 12, 12', and a pair of additional coupling holes 13, 13' formed parallel to endmost left and right coupling holes 13, 13'. Therefore, the perforated braid with twenty-six strands of braided yarns 2, 2' can be produced by twenty-six carriers 20 traveling along the carrier contours 14, 14' formed by total of twelve coupling holes 13, 13'.

Figure 17:
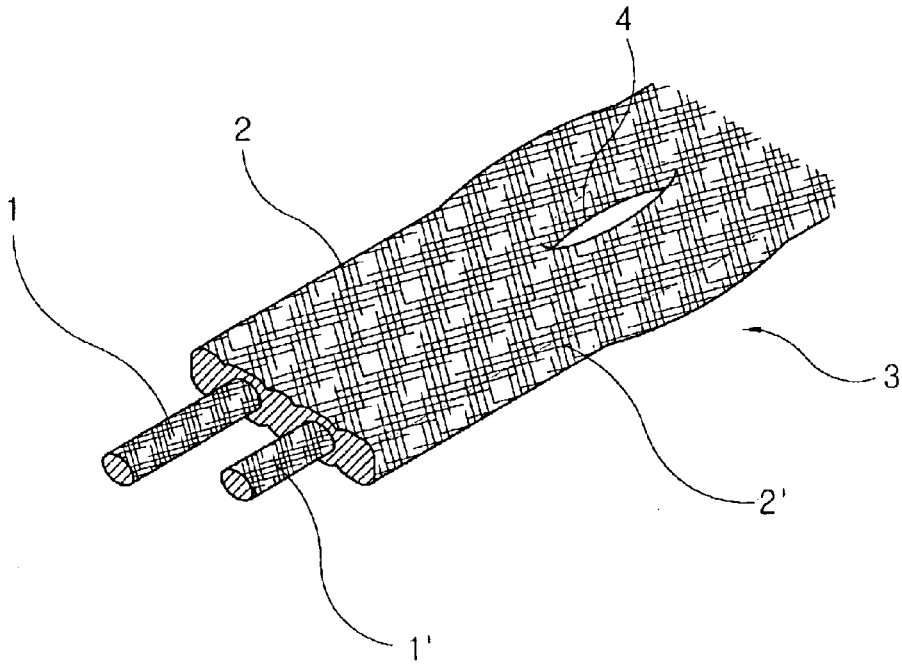
FIG. 17 is an expansion perspective view of the perforated braid with a rectangular cross-section produced by the carrier guide plate of FIG. 16.

Referring to FIG. 17, a perforated braid with a rectangular cross-section being produced by aforementioned carrier guide plate comprises dual core yarns 1, 1' bound parallel apart by a certain distant, and a common exterior braid 3. The common exterior braid 3 has a plurality of perforations 4, 4' with constant intervals. The perforated braid with rectangular cross-section is suitable to use for flat-type straps such as soccer shoe straps. When the perforated braid with rectangular cross-section is applied to the soccer shoes, it is possible to reduce the chances of loosening the strap during exercising. Because of the rectangular cross-section, it will increase the binding force on the strap.

Hereinafter, a process for braiding the yarns 2, 2' by the braiding apparatus of the present invention is described according to the aforementioned explanations.

The multiple braided yarns 2, 2' are wound on a plurality of carriers 20 which are engaged with the feed discs 31. The core yarns 1, 1' drawn from underneath the carrier guide plate 10 are inserted into the core yarn holes 12, 12'.

At this point, a plurality of feed gears 30 driven by feed motor (not shown) is arranged so that a group of feed gears 30 rotate clockwise. Simultaneously, the other group of feed gears 30 rotates counterclockwise at a constant speed.

As two groups of the feed gears 30 are rotating simultaneously in the opposite directions, the feed discs 31 mounted on top of the shaft 30*a* are also rotating in two groups of directions. The carrier base 21 disposed lower part of the carriers 20 engages with the feed discs 31 to travel along the carrier contours 14, 14'. The rotation of the feed discs 31 causes the carriers 20 to rotate. Thereby the carriers 20 are continuously traveling along the carrier contours 14 and 14'.

The multiple yarns 2, 2' are braided for surrounding the outer surface of the core yarns 1, 1' while the carriers 20 are traveling and rotating. At this point, the carriers 20 are crossed each other at the crossing sections of the carrier contours 14, 14' for producing braiding yarns 2, 2'. The thusly produced braid is wound on the winding rollers (not shown), which are rotating with same braiding speed.

The process for braiding one strand of braid is described as follows.

When the pair of actuator 42, 42' operates corresponding carrier contour changer 50, 50' forward or rearward, each intermediate cross block 70 and inner split blocks 80 in each change block assembly 90, 90' moves ascending or descending, respectively. For instance, if the carrier contour changer 50 moves forward direction, the intermediate cross block 70 descends and the inner split blocks 80 ascends. If the carrier contour changer 50 moves rearward, the intermediate cross block 70 ascends and the inner split block 80 descends, due to the disposition of the fixing pin 53. The crossed carrier contour changer 50' operates in the same manner as the intermediate cross block 70 and inner split blocks 80 of the change block assembly 90' ascending or descending respectively depending on the location of the fixing pin 53'. Through this operation, two carrier contours 14, 14' are provided two tracks of forward and backward traveling for two groups of carriers 20.

At this moment, one group of carriers 20, the carrier numbers one to twelve move along the carrier contours 14, 14' in the counterclockwise and the other group of carriers 20, for example the carrier letters A to L move along the carrier contours 14, 14' clockwise.

Thusly, the multiple yarns are braided while they are moving in forward and backward directions to form one strand of braid composed of twenty-four strands of yarns having dual core yarns 1, 1'.

For forming perforations at a certain section during the process of braiding one strand of braid, the core yarns 1, 1' must be braided and separated with each other to form two braids having each core yarn 1, 1'. At this point, the carrier contour changers 50, 50' are operated in the opposite direction by the actuators 42 and 42' disposed underneath the base plate 40. Accordingly, the left and right sides of two carrier contours 14, 14' are provided for four carrier contours for the splitting operation.

For example, one strand of braid is produced that one group of the carriers (carrier number one, two, three, ten, eleven and twelve among the multiple carriers) rotates around the core yarn hole 12 while other group of the carriers (carrier number or letter A, B, C, D, K, and L among the multiple carriers) reverse rotate around the core yarn hole 12.

Meanwhile, other side strand of braid is produced that one group of the carriers (carrier number four, five, six, seven, eight and nine among the plurality of carriers) rotates around the core yarn hole 12', while another group of the carriers (carrier number or letter e, f, g, h, I and j among the plurality of carriers) rotate in a reverse direction around the core yarn hole 12'.

Hence, two carrier contours 14, 14' are provided two tracks of circular-shaped zigzag pattern for splitting and forming the braid. Thusly, the braid having two strands of braid with twelve strands of yarns 2, 2' is produced thru this device.

In this manner, the two strands of braided section is formed a perforation section. When a desired size of perforation 4, 4' is produced by the two strands of braid, the carrier contour changers 50, 50' are returned to the original position.

The path of carrier contours 14, 14' are alternatively switched each other by the carrier contour changers 50, 50'. Thus, one strand or two strands of braid having perforations 4, 4' with constant intervals are continuously produced by alternative splitting and braiding operation.

With thusly produced braid of the present invention, it is possible to bind the braids without a knot by piercing one braid passing through the perforations 4, 4' with each other. Subsequently, the binding is comfortable and discreet to apply excessive force because it is not easily untied nor loosened.

On the other hand, if it were necessary to untie the binding portion, it would be untied easily by releasing the braid retreating from the perforations 4, 4'. Thus, it is easily and conveniently tie or releasing the binding portion.

If the perforated braid of the present invention is used for shoes straps, the problem of loosening or untie straps during an exercise can be solved due to the new binding device. Also, the strap length can be remarkably reduced to fit on the shoes with proper binding force. Consequently, the overall weight of the shoes can be reduced and the feasibility can be maximized.

If the perforated braid of the present invention is further applied to the fishing nets or mainlines, a branch line would be connected through perforations, which are formed with constant intervals. Due to the binding of perforations and branch lines, the displacement problem of the fishing nets can be solved.

As described above, the perforated braid of the present invention is applicable to various purposes by changing in size and intervals of the perforations.

The perforated braid with dual core yarns and the braiding apparatus according to the present invention provides firm binding as well as easy untie binding device because of a binding means without knit. Particularly, the perforated braid, when applied to fishing nets or fishing lines, provides easy binding means so that the branch lines are binding through the perforations with same intervals. The new binding means is also solves shifting problems of the branch lines. If the perforated braid were applied to the shoe straps, it could solve the loosening problem during exercise. It is also able to reduce the length of the shoe straps and maximize the flexibility. Further, the size and interval of the perforation can be changed depending on the various usages.

The present invention has been described in an illustrative manner and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

What is claimed is:

1. A braiding apparatus for braiding a perforated braid comprises:

a carrier guide plate (10) providing a pair of core yarn holes (12, 12') at each center of each left half and right half thereof, a plurality of coupling holes (13, 13') formed in radial direction around circumference of each core yarn hole (12, 12') on said carrier guide plate (10), two tracks of carrier contours (14, 14') formed in circular zigzag patterns with a certain depth along the circumferential coupling holes (13, 13'), said two tracks of carrier contours (14, 14') forming inner and outer paths around said coupling holes (13, 13') to cross each other, four square slots (15, 15') perpendicularly arranged each other to form a cross center on time two tracks of the carrier contours (14, 14') at a center of said carrier guide plate (10), a plurality of carriers (20) installed on said carrier contours (14, 14') for rotating and traveling along said carrier contours (14, 14'), a base plate (40) disposed underneath said carrier guide plate (10) at a certain distance, a plurality of feed gears (30) rotatably mounted on said base plate (40), a number of said feed gears (30) being equal to the number of said carriers (20), a plurality of feed discs (31) fixed on top of feed gear shafts (32), and said feed discs (31) interposed into carrier bases (21) located at the lower part of said carriers (20), a pair of carrier contour changers (50, 50') mounted underneath said carrier guide plate (10) and inserted into the four square slots (15, 15') for operationally providing alternate tracks of said carrier contours (14, 14') to cross and separate the carriers (20) at the cross center of said carrier contours (14, 14'), and a pair of actuators (42, 42') mounted underneath said base plate (40) connected to said carrier contour changers (50, 50') through an operating rod (41), a linkage (43) and a change rod (51), for repeatedly performing the crossing and separating operations.

2. The braiding apparatus of claim 1, wherein said carrier guide-plate (10) provides a total of eight coupling holes (13, 13') and the corresponding carrier contours (14, 14') formed in radial direction around the circumference of each core yarn hole (12, 12') on said carrier guide plate (10), eight feed discs (31) mounted on the coupling holes (13, 13'), and sixteen carriers (20) for sixteen strands of core yarns.

3. The braiding apparatus of claim 1, wherein said carrier guide plate (10) provides a total of twelve coupling holes (13, 13') and the corresponding carrier contours (14, 14') arranged in the manner that eight coupling boles (13, 13') are formed in radial direction around the circumference of each core yarn hole (12, 12') and each pair of additional coupling holes (13, 13') is disposed parallel to the leftmost and rightmost coupling holes (13, 13') on said carrier guide plate (10), twelve feed discs (31) mounted on the coupling holes (13, 13'), and twenty-six carriers (20) for twenty-six strands of core yarns to braid a perforated braid having a rectangular cross-section.

4. The braiding apparatus of claim 1, wherein said carrier guide plate (10) provides a total of twelve coupling holes (13, 13') and the corresponding carrier contours (14, 14') formed in radial direction around the circumference of each core yarn hole (12, 12') on said carrier guide plate (10), twelve feed discs (31) mounted on the coupling holes (13, 13'), and twenty-four carriers (20) for twenty-four strands of core yarns.

5. The braiding apparatus of claim 1, wherein said carrier guide plate (10) provides a total of sixteen coupling holes (13, 13') and the corresponding carrier contours (14, 14') formed in radial direction around the circumference of each core yarn hole (12, 12') on said carrier guide plate (10), sixteen feed discs (31) mounted on the coupling holes (13, 13'), and thirty-two carriers (20) for thirty-two strands of core yarns.

6. The braiding apparatus of claim 1, wherein said carrier guide plate (10) provides a total of twenty coupling holes (13, 13') and the corresponding carrier contours (14, 14') formed in radial direction around the circumference of each core yarn hole (12, 12') on said carrier guide plate (10), twenty feed discs (31) mounted on the coupling holes (13, 13'), and forty carriers (20) for forty strands of core yarns.

7. The braiding apparatus of claim 1, wherein a pair of carrier contour changers (50, 50') mounted underneath said carrier guide plate (10) further comprises a pair of change block assemblies (90, 90') and operating frames (52, 52').

8. The braiding apparatus of claim 7, wherein a pair of change block assemblies (90, 90') further comprises:

a main block (60) having a longitudinal slot (61) formed at the lower center of both lateral surfaces that penetrates through the block transversely, a pair of vertical coupling holes (67, 67') formed at opposite ends and perforated at a right angle, a protruding portion (62) formed at the center between both coupling holes (67, 67') and a concave recess (63), a vertical split rising opening (65) of rectangular shape formed at the center of the concave recess (63) and both side projections (64, 64') constituting the protruding portion (62), and cross rising openings (66) of triangular shape formed at opposite sides of the split rising openings (65), an intermediate cross block (70) having an inclined slot (71) penetrating through the block, a vertical insertion opening (72) formed at the center of the cross block (70) and a pair of cross guide flaps (73, 73') formed at opposite sides of the vertical insertion opening (72) for mating with the cross rising opening (66) of the main black (60), an inner split block (80) having a declined slot (81) formed at the lateral surface in the opposite direction of the inclined slot (71) of said intermediate cross block (70) and a split guide flap (82) formed at the center of the upper portion to mate with the split rising opening (65) of said main block, and a pair of fixing pins (53) inserted from one lateral side of the operating frames (52, 52') for sequentially mounting said main block (60), intermediate cross block (70) and inner split block (80) on said operating frames (52, 52').

9. The braiding apparatus of claim 8, wherein the two operating frames (52, 52') are arranged to cross each other, the upper operating frame (either 52 or 52') has a fixing pin (53) located at the center of its frame thickness, and the lower operating frame (either 52 or 52') includes a raised mounting portion corresponding to the location of the fixing pin (53') on the above operating frame (52 or 52'), so that each fixing pin (53, 53') mounted on the operating frames (52, 52') is located at the same distance below the carrier guide plate (10).

10. The braiding apparatus of claim 8, wherein an inner lateral surface of the concave recess (63) of said main block (60) has a convex shape protruding inwards and an outer lateral surface of said cross guide flaps (73, 73') of said intermediate cross block (70) and both lateral faces of the split guide flaps (82) of said inner split block (80) have an inwardly recessed concave shape, so that said carrier base (21) is able to move smoothly along said carrier contours (14, 14').

* * * * *